United States Patent [19]

Breton et al.

[11] Patent Number: 4,766,051

[45] Date of Patent: Aug. 23, 1988

[54] COLORED ENCAPSULATED TONER COMPOSITIONS

[75] Inventors: Marcel P. Breton, Toronto; Terry L. Bluhm, Oakville; Kar P. Lok, Sarnia, all of Canada

[73] Assignee: Xerox Corporation, Stamford, Conn.

[21] Appl. No.: 902,725

[22] Filed: Sep. 2, 1986

[51] Int. Cl.[4] ..... G03G 9/08

[52] U.S. Cl. ..... 430/138; 428/402.24

[58] Field of Search ..... 430/138, 394, 502; 428/402.24

[56] References Cited

U.S. PATENT DOCUMENTS

| | | | |
|---|---|---|---|
| 3,669,922 | 6/1972 | Bartsch et al. | 240/41 R |
| 3,770,692 | 11/1973 | Miller | 260/41 C |
| 4,307,169 | 12/1981 | Matkan | 430/98 |
| 4,439,510 | 3/1984 | McLoughlin | 430/137 |
| 4,497,885 | 2/1985 | Ushiyama et al. | 430/106.6 |
| 4,565,764 | 1/1986 | Nakahara et al. | 430/111 |
| 4,587,194 | 5/1986 | Adair et al. | 430/138 |

*Primary Examiner*—John L. Goodrow

*Attorney, Agent, or Firm*—E. O. Palazzo

[57] ABSTRACT

A cold pressure fixable colored toner composition comprised of a core containing a polymer in which is dispersed pigment particles selected from the group consisting of cyan, magenta, red, yellow pigments, and mixtures thereof, other than carbon blacks and magnetites; and encapsulated within a polymeric shell formulated by an interfacial polymerization.

18 Claims, No Drawings

COLORED ENCAPSULATED TONER COMPOSITIONS

BACKGROUND OF THE INVENTION

The present invention is generally directed to encapsulated toner compositions, and more specifically the present invention is directed to colored encapsulated toner compositions formulated by interfacial polymerization processes. Thus, in one embodiment the present invention is directed to cold pressure fixable toner compositions comprised of readily available, and economical colored pigments encapsulated within a polymeric shell obtained by interfacial polymerization processes. The aforementioned toner compositions are useful for permitting the development of images in electrostatographic systems, inclusive of electrostatic imaging processes wherein pressure fixing, especially pressure fixing in the absence of heat, is selected.

Encapsulated, and cold pressure fixable toner compositions are known. Cold pressure fixable toners have a number of advantages as compared to toners that are fused by heat, primarily relating to the requirements for less energy since these toner compositions can be fused at room temperature. Nevertheless, many of the prior art cold pressure fixable toner compositions suffer from a number of deficiencies. For example, these toner compositions must usually be fused under high pressure, which has a tendency to severely disrupt the fusing characteristics of the toner selected. This can result in images of low resolution, or no images whatsoever. Also, with some of the prior art cold pressure toner compositions substantial image smearing can result from the high pressures required and from the use of plasticizer type materials in large quantities. Additionally, the cold pressure fixing toner compositions of the prior art have other disadvantages in that, for example, these compositions when used for development cause in some instances images with high gloss that are of low crease resistance. Furthermore, the images resulting exhibit an undesirable carbon paper effect, thus there is a total or partial image transfer from the image substrate to neighboring substrates caused by pressures arising from normal handling. In contrast, images developed with the cold pressure compositions prepared in accordance with the process of the present invention possess a low gloss appearance on plain paper, and further there is no carbon paper effect observed. Also, the toner compositions prepared in accordance with the process of the present invention have hard shells thus enabling images of excellent resolution with substantially no background deposits.

With further reference to the prior art, there is disclosed in U.S. Pat. No. 4,307,169 microcapsular electrostatic marking particles containing a pressure fixable core, and an encapsulating substance comprised of a pressure rupturable shell wherein the shell, such as a polyamide is formed by an interfacial polymerization. Furthermore, there is disclosed in U.S. Pat. No. 4,407,922 pressure sensitive toner compositions obtained by interfacial polymerization processes, and comprised of a blend of two immiscible polymers selected from the group consisting of certain polymers as a hard component, and polyoctyldecylvinylether-comaleic anhydride as a soft component.

Examples of patents illustrating color photocapsule toners are U.S. Pat. Nos. 4,399,209; 4,482,624; 4,483,912; and 4,397,483. More specifically, the U.S.

Pat. No. 4,397,483 illustrates encapsulated toner materials which have applications in very specific areas such as pressure sensitive recording paper. Capsules prepared for this application are usually coated on a substrate directly from the emulsion in which they are prepared and withstand difficult spray drying processes, a disadvantage alleviated with the toners prepared in accordance with the process of the present invention. Furthermore, these capsules contain an organic liquid in the core which, when used in a dry development system, could result in poor fix properties. Also, the range of particle sizes prepared by the aforementioned process results in the formation of pressure sensitive recording particles which are usually not acceptable for electrostatographic development systems. In the U.S. Pat. Nos. 4,399,209, 4,482,624 and 4,483,912 there are described toner compositions with costly encapsulated radiation sensitive components thereby necessitating the need for an image forming agent. Further, contrary to the process of the present invention, wherein the cold pressure fixable toner composition can be developed and imaged on plain paper, imaging using capsules illustrated in these Patents require paper or other appropriate substrates which have been treated by an acid developer, for example.

With further reference to the prior art, there is disclosed in U.S. Pat. No. 4,476,211 the preparation of electrostatographic toner materials with surface electroconductivity. Specifically, there is disclosed in the U.S. Pat. No. 4,476,211 a cold pressure fixable toner composition with polyamide, polyurea and other types of shell materials prepared by an interfacial polymerization process. The colorant selected for these compositions is generally comprised of a variety of dyes or pigments, and the core contains a polymeric material with a binder therein for retaining the colorant within the core and assisting in the fixing of the the colorant onto the surface of a support medium. Examples of high boiling liquids selected for the process of the U.S. Pat. No. 4,476,211 include those boiling at temperatures higher than 180° C. such as phthalic esters, phosphoric acid esters, and alkylnaphthalenes.

Moreover, illustrated in a copending application U.S. Ser. No. 621,307, the disclosure of which is totally incorporated herein by reference, are single component cold pressure fixable toner compositions, wherein the shell selected can be prepared by an interfacial polymerization process. A similar teaching is present in copending application U.S. Ser. No. 718,676 relating to cold pressure fixable toners, the disclosure of which is totally incorporated herein by reference. In the aforementioned application, the core can be comprised of magnetite and a polyisobutylene of a specific molecular weight encapsulated in a polymeric shell material generated by an interfacial polymerization process.

Accordingly, there is a need for improved colored encapsulated toner compositions. Also, there is a need for colored encapsulated toner compositions containing therein inexpensive pigments, such as printing ink substances. There is also a need for colored cold pressure fixable toner compositions with economical newsprint colorants therein. Additionally, there is a need for simple economical polymerization processes that will permit the generation of encapsulated cold pressure fixable toner compositions, especially compositions with hard shells. There is also a need for improved processes that will enable cold pressure fixable toner compositions with hard shells, and wherein the monomer selected for the shell is dissolved in the core.

SUMMARY OF THE INVENTION

It is an object of the present invention to provide improved colored encapsulated toner compositions which overcome some of the above-noted disadvantages.

In another object of the present invention there are provided colored cold pressure fixable toner compositions with hard shells formulated by an interfacial polymerization process.

Also, in a further object of the present invention there are provided encapsulated toners with colored newsprint inks containing polymers, and economical pigments therein.

Further, an additional object of the present invention resides in simple, and economical processes for the preparation of colored encapsulated toners by interfacial polymerization processes.

An additional object of the present invention resides in the provision of encapsulated toners with color pigments.

A further additional object of the present invention resides in the provision of encapsulated toners with compatible color oil soluble dyes which can be trapped within block copolymer domains, and wherein the block copolymer microdomains are "mini-reservoirs" of an ink like material.

Another object of the present invention resides in the provision of encapsulated toners with oil soluble dyes which can be trapped within the core by polymerization of the medium in which the dye is dissolved, and wherein the solvent selected is replaced in whole or in part by a polymerizable monomer.

These and other objects of the present invention are accomplished by the provision of colored encapsulated toner compositions comprised of a core containing polymer particles, pigment particles, and optional oil components encapsulated within a shell generated by interfacial polymerization processes. Further, in accordance with the present invention there are provided cold pressure fixable colored toner compositions comprised of a core of polymer, colored pigments, and optional additive particles, inclusive of collodial silicas, and metal salts of fatty acids encapsulated in a shell formulated by interfacial polymerization processes. Therefore, in one specific embodiment of the present invention the cold pressure fixable toner compositions are comprised of a core of a polymer having dispersed therein as pigments components selected from the group consisting of inexpensive newsprint inks, cyan, magenta, yellow, red, and mixtures thereof, excluding carbon blacks, and magnetites. Moreover, as substitutes for the pigment components there can be selected commerically available newsprint inks, as illustrated herein, and comprised of polymers, and inexpensive pigments. Additive particles, such as colloidal silicas, inclusive of Aerosils, and/or metal salts, or metal salts of fatty acids, inclusive of zinc stearate can be added to the encapsulated toner, including the toner core, which core is encapsulated with a polymeric shell obtained by an interfacial polymerization process. Furthermore, there is provided in accordance with the present invention processes for the preparation of cold pressure fixable toner compositions wherein the hard shell components is obtained by hydrolysis, and interfacial polymerization.

Various specific suitable polymers, in an amount of from about 20 to about 80, and preferably from about 20 to about 70 percent by weight can be selected for incorporation into the core of the toner composition of the present invention providing that the objectives thereof are achievable. Illustrative examples of polymers include polyolefins, especially polyolefin copolymers such as polyisobutylenes, particularly those with a molecular weight of from about 50,000 to 100,000, polystyrene-butadiene copolymers, and polybutadienes; polybutenes, polyisoprenes, polysiloxane copolymers, and the like. The core may also contain a polymer which can be formulated by, for example, an in situ radical polymerization subsequent to the initial encapsulation process. Examples of specific suitable monomers that can be selected for polymerization are styrene, acrylates, methacrylate monomers, mixtures thereof, and the like. To effect the aforementioned polymerization, there can be utilized from about 0.5 to about 4 percent by weight of monomer azo type initiators such as azobisisobutylronitrile, available from Aldrich, 2,2-azobis (2,4-dimethyl valeronitrile), and the like.

Examples of useful pigments or colorants present in various effective amounts of, for example, from about 5 to 50 percent by weight include magenta, yellow, cyan, or mixtures thereof, and red pigments. Specific examples of other useful pigments present in an amount of from about 5 to about 25 percent by weight in the toner include Heliogen Blue L6900, D6840, D7020, Pylam Oil Yellow, Pigment Blue 1, available from Paul Uhlich & Co. Inc., Pigment Violet 1, and Pigment Red 48, also available from Uhlich & Co. Inc., Lemon Chrome Yellow DCC 1026, and Bon Red C, available from Dominion Color Corp., Ltd., Toronto, Ontario, Novaperm Yellow FGL, Hostaperm Pink E, available from Hoechst, Cinquasia Magenta, available from E.I. DuPont de Nemours & Co., chrome pigments, molybdate orange, benzidine yellow, the Hansa yellows, tartrazine lakes, cadmium yellows and oranges, zinc yellow, red lead, lithol reds, toluidine reds, Alizarine pigments, B.O.N. Maroon, Tungstated rhodamines, Fire red pigments, Helio bordeaux reds and Watchung red. Also, as a substitute for the pigments there can be preferably selected rubber based printing inks available from Canadian Fine Color Co., which inks are believed to be comprised of a polymer, and certain unidentified inexpensive pigments. Furthermore, the aforementioned unidentified pigments subsequent to separation from the polymer can be selected for the toner compositions of the present invention.

Although not preferred, there can be selected in place of the disclosed pigments dyes such as Oil Blue A, Passaic Oil Green, Sudan Red, Sudan Yellow 146, DuPont Oil Blue A, Passaic Oil Red 2144, Oil Yellow, Sudan Red 7B, Oil Pink 312, Pylachrome Pink LX1900, Sudan Black B, Ceres Blue R, Sudan Deep Black, Ceres Black BN, and other dye mixtures. The dye can be present in the organic core in the amount from about 1 percent to about 40 percent by weight, and preferably in an amount of from about 15 percent by weight to about 25 percent by weight.

The core may further contain, in an amount of from about 1 to about 15 percent by weight, drying oils, natural and synthetic resins, and synthetic rubber products. Additives, in an amount of from 1 percent to about 40 percent by weight, and preferably in an amount of from about 1 to about 15 percent by weight, such as metallic soaps, waxes, silicone derivatives and/or other releasing agents, that is additives which reduce adhesion of the toner to the fuser roll in xerographic apparatuses can also be incorporated into the toner compositions of the present invention. Moreover, and specifically the toners of the present invention can contain therein in amounts of from, for example, from about 0.1 to about 5 percent by weight collodial silicas, such as Aersoil R972, metal salts, and/or metal salts of fatty acids, reference U.S. Pat. Nos. 3,590,000; 3,655,374; 3,900,588; and 3,983,045, the disclosures of which are totally incorporated herein by reference.

As shell component examples, present in an amount of from about 15 to about 50 percent by weight, there is mentioned aromatic polyureas, polyurethanes, polyamides, and the like.

The cold pressure fixable toner compositions of the present invention can be prepared by a number of suitable methods. One preferred method of preparation comprises (1) dispersing newsprint ink concentrates, such as those available from Canadian Fine Color Co., in an amount of from about 5 percent to about 50 percent by weight of the toner, and preferably from 10 to 40 percent by weight, in toluene diisocyanate, in an amount of from about 8 percent to about 20 percent by weight, and tris(p-isocyanato-phenyl)thiophosphate in an amount of from about 1 percent to about 10 percent by weight, in a solution containing polyisobutylene present in an amount from about 25 percent to about 60 percent by weight, contained in a mixed organic solvent system with, for example, cyclohexane and dichloromethane; (2) thereafter dispersing the resulting organic component in water in an amount of from about 10 percentto about 50 percent by weight, containing from about 0.2 percent to about 2.0 percent by weight of poly(vinyl alcohol) or similar surfactants, preferably by using a shear homogenizer; (3) subsequently heating the reaction mixture at a sufficient temperature, preferably from about 50 to about 70 degrees Centigrade to permit hydrolysis; followed by an interfacial polymerization, shell formation; thereafter heating the mixture at a higher temperature, preferably from about 70 to about 90 degrees Centigrade, enabling further interfacial polymerization, and organic solvent evaporation thereby allowing the formation of a toner with a hard shell having a high modulus and low extension to break.

Other processes that may be selected for the preparation of the toner compositions of the present invention include, for example (1) admixing a core component comprised of pigment particles, a water insoluble organic solvent, an elastomeric material and shell monomers dissolved therein; (2) dispersing the mixture in a water phase containing a stabilizing material; (3) adding to the water phase a comonomer which interfacially reacts with the shell monomer present in the water insoluble organic solvent; (4) subjecting the mixture that results to heating to enable the completion of the interfacial polymerization, followed by evaporating the water insoluble organic solvent; and thereafter (5) washing and spray drying the resulting toner particles. Another specific process embodiment comprises (1) admixing a core component compound of rubber base newsprint inks, a water insoluble organic solvent and an elastomeric material, and a shell monomer dissolved therein; (2) dispersing the mixture in a water phase containing a stabilizing material; (3) hydrolizing the shell monomer dissolved therein by heating at a temperature of from about 35 to about 70 degrees Centigrade; (4) subjecting the mixture that results to heating for effecting interfacial poiymerization; and (5) washing and spray drying the resulting toner particles.

Interfacial polymerization processes selected for the shell formation are as illustrated, for example, in U.S. Pat. Nos. 4,000,087; 4,307,169; and 3,429,827, the disclosures of which are totally incorporated herein by reference. In one interfacial process applicable to the present invention, there is emulsified in an aqueous phase containing a dispersant a nonaqueous phase containing di- and tri-functional reacting materials, such as TDI-80, a mixture of 2,4 and 2,6 toluene diisocyanate and Desmodur RF (tris(p-isocyanato-phenyl)thiophosphate). Under high shear conditions, microdroplets of the organic phase are formed. Upon addition of a co-reacting material such as diethylenetriamine in the water phase, a shell is formed at the aqueous/nonaqueous interface to yield an encapsulated material.

With further regard to the process of the present invention, a specific cold pressure fixable toner can be prepared by mixing a solution of polyisobutylene (Vistanex LMMH) in cyclohexane containing 6.4 percent toluene diisocyanate and 7.9 percent of a trifunctional isocyanate crosslinking agent such as Desmodur RF as a 20 percent solution in dichloromethane, and 1.33 percent of Sudan Blue in 13.3 percent of additional dichloromethane. This organic mixture is then dispersed by a polytron in an aqueous phase containing 0.75 percent polyvinylalcohol to obtain toner particles. By raising the reaction temperature, some of the reactive components migrate to the water/oil interface and hydrolyze to amine groups. Reaction of these amine groups with the remaining isocyanate groups provide an aromatic polyurea shell. To compensate for the different reinforcing properties of the pigments, the molecular weight of the starting elastomer can be modified, and/or specific amounts of a reinforcing block copolymer such as a styrene-butadiene, styrene-isoprene, and/or specific amounts of siloxane containing copolymers from about 1 to about 10 percent by weight, can be added. Also, various anti-foaming agents such as those described in German Patent Publication No. 3245482 could be used to minimize foaming. Pre-polymerized isocyanate materials can also be added as core materials to provide special mechanical properties to the toner, and to enable the modification of the shell building mechanisms.

The toner compositions of the present invention are useful for enabling the development of colored electrostatic latent images, particularly those contained on an imaging member charged negatively. Examples of imaging members that may be selected are various known organic photoreceptors including layered photoreceptors. Illustrative examples of layered photoresponsive devices include those with a substrate, a photogenerating layer, and a transport layer as disclosed in U.S. Pat. No. 4,265,990, the disclosure of which is totally incorporated herein by reference. Examples of photogenerating layer pigments are trigonal selenium, metal phthalocyanines, metal free phthalocyanines, and vanadyl phthalocyanines. Transport material examples are various diamines dispersed in resinous binders. Other organic photoresponsive materials that may be utilized in the practice of the present invention include polyvinyl carbazole, 4-dimethylaminobenzylidene, benzhydrazide; 2-benzylidene-amoni-carbazole; (2-nitro-benzylidene)-p-bromoaniline; 2,4-diphenyl-quinazoline; 1,2,4-triazine; 1,5-diphenyl-3-methyl pyrazoline; 2-(4'-dimethyl-amino phenyl)-benzoxazole; 3-amino-carbazole; polyvinylcarbazole-trinitrofluorenone charge transfer complex; and mixtures thereof. Further, imaging members that can be selected are selenium and selenium alloys, zinc oxide, cadmium sulfide, hydrogenated amorphous silicon, as well as ionographic surfaces of various dielectric materials such as polycarbonate, polysulfone, fluoropolymers, anodized aluminum alone or filled with wax expanded fluoropolymers.

Also, to be disclosed herein are three alternative means of dispersing dyes in toners obtained by combining the block copolymer approach and interfacial polymerization processes such as radical initiated polymerization within the already formed toner shell. The first method involves the use of an oil soluble dye with, or without an oil which can be trapped within block copolymer domains because of their compatibility. A dye which is more compatible with the core material (block copolymer with domain structure) than the solvent would be used in order to minimize dye diffusion to the toner surface during solvent evaporation. As a further insurance against dye diffusion, a shell material can be designed so as to selectively release the solvent. It is thus proposed to utilize block copolymer microdomains as "mini-reservoirs" of an ink like material. Under pressure generated by a fixture such as a Hitachi three roll fuser (operating at 1,500–2,500 psi) the dyed oil will migrate into the paper acting as an ink in a manner that will improve the covering power of the toner, the optical uniformity of the cold pressure fixed image and the archival properties of the image. The archival properties will now depend on the fading characteristics of the dye chosen. The result is a much improved image in that the optical density of the image is increased when compared with an image prepared using conventional colored cold pressure fixable imaging materials.

The second method involves the use of an oil soluble dye which can be trapped within the block copolymer domains because of its solubility in one of the domains. The dye may be compatible with a solvent. In this situation it is proposed to polymerize the medium in which the dye is dissolved thus preventing diffusion of the dye molecules to the toner surface. Therefore, the solvent selected must be replaced by a polymerizable monomer. The dye itself could also be used as a comonomer. Compression moduli of these materials can be controlled by the appropriate choice of the starting monomer or either by using chain transfer agents during the polymerization for control of molecular weight or by addition of plasticizers.

The third method involves a special property of block copolymers, that being micelle formation in selective solvents. When a block copolymer such as poly(styrene-n-butadiene) (Kraton®) is placed in a solvent which is selective for one of the blocks, micelles of submicron size are formed with the insoluble block permitting a core surrounded by a corona composed of the soluble block. Dyes which under normal conditions would not be soluble or might be only partially soluble in the chosen medium can be stabilized in the micelle cores. Subsequent collapse of the micelles would produce a core material suitable for use in a toner in which a dye that is normally not soluble in the chosen medium is entrapped. Aggregation of the dye molecules with associated adverse effects on the toner electrical properties can in this way be prevented.

The following examples are being supplied to further define various species of the present invention. These examples are intended to be illustrative only and are not intended to limitthe scope of the present invention Also parts and percentages are by weight unless otherwise indicated.

EXAMPLE I

A colored cold pressure encapsulated toner was prepared as follows: Novaperm Yellow FGL (Hoechst), 5 grams; Vistanex LMMH, 12 grams; cyclohexane ACS (Caledon) 50 grams; and 5 mm (millimeters) diameter ball bearings (⅓ of the total volume) were placed in a 250 milliliter plastic bottle and ball milled for 16 hours. Thereafter, TDI-80, a mixture of 2,4 and 2,6 toluene diisocyanate, 9 grams, and Desmodur RF (tris(p-isocyanato-phenyl)thiophosphate), 5 grams, in dichloromethane, 20 milliliters were added to the pigment mixture. The mixture was then homogenized with a Brinkmann homogenizer PT 10-35 set at speed 9 for 90 seconds (generator PT-20). Thereafter, the mixture was then dispersed in a 1 percent poly(vinyl alcohol) solution, 500 milliliters and 2-decanol, 0.5 milliliter with a Brinkmann homogenizer PT 10-35 set at speed 7 for 15 seconds (generator PT 35/4). Subsequently, this mixture was transferred to a 2 liter beaker equipped with a mechanical stirrer, and an oil bath under the beaker. Diethylenetriamine, 5 milliliters in water, 22 milliliters, was added to the aforementioned mixture over a period of 2 minutes, and the mixture was kept at room temperature overnight. During this period an interfacial polymerization reaction ensued enabling the polyurea polymer shell to formulate. The next day, the temperature was increased to 65° C. for 8 hours to permitthe reaction to proceed to completion and to remove volatiles, such as the residual solvents, cyclohexane and dichloromethane. The reaction mixture was then allowed to stabilize at room temperature, and the yellow toner resulting was comprised of a polyisobutylene core polymer, about 37 percent by weight, the yellow pigment, 16 percent by weight and a polyurea shell 47 percent by weight.

EXAMPLE II

A cold pressure encapsulated toner was prepared by repeating the process of Example I with the exceptions that Hostaperm Pink E, 5 grams, was used instead of Novaperm Yellow FGL, and the polymer/pigment solution was homogenized for 10 seconds. Also, this toner was spray dried using a Buchi 190 mini spray dryer at an inlet temperature of 128° C. and outlettemperature of 85° C. The magenta toner resulting was comprised of polyisobutylene core polymer, about 37 percent by weight; the pigment, 16 percent by weight; and a polyurea shell, about47 percent by weight.

EXAMPLE III

A cold pressure encapsulated toner was prepared as follows: Pilam oil blue (Pilam Products Corp.) #720824, 5 grams; Vistanex LMMH, 12 grams; cyclohexane ACS (Caledon), 50 grams and 5 mm (dia) ball bearings (⅓ of total volume) were placed in a 250 milliliters plastic bottle and ball milled for 15 hours. TDI-80, a mixture of 2,4 and 2,6 toluene diisocyanate, 9 grams, and Desmodur RF (tris(p-isocyanato-phenyl)thiophosphate), 5 grams, in dichloromethane, 20 milliliters, were added to the pigment mixture after ball milling. The polymer/pigment mixture was homogenized with a Brinkmann homogenizer PT 10-35 set at speed 8 for 90 seconds. The mixture was then dispersed in a 1 percent poly(vinyl alcohol) solution, 1,000 milliliters, and 2-decanol, 0.5 milliliter, with a Brinkmann homogenizer PT 10-35 set at speed 6 for 10 seconds. This mixture was transferred to a 2 liter beaker equipped with a mechanical stirrer, and an oil bath under the beaker. After 10 minutes of stirring, diethylenetriamine, 5 milliliters, in water, 22 milliliters, was added to it over a period of 20 seconds. The mixture was kept at room temperature for 3 hours. During this period an interfacial polymerization reaction ensued enabling the polyurea polymer shell to formulate. The temperature was then increased overnight to 70° C. permitting completion of the polycondensation, and enabling the removal of cyclohexane and dichloromethane. Thereafter, the reaction mixture was allowed to stabilize at room temperature. Subsequently, the toner obtained was filtered through a 212 μm (micron) mesh filter, washed 3 times with water and then spray dried at an inlet temperature of 128° C. and an outlet temperature of 84° C. The blue toner resulting was comprised of a polyisobutylene core polymer, about 37 percent by weight; blue pigment, about 16 percent by weight; and a polyurea shell polymer, about 47 percent by weight.

EXAMPLE IV

A cold pressure encapsulated toner was prepared as follows: Pigment Blue 1 (Paul Uhlich & Co. Inc.), 10 grams; Vistanex LMMH, 24 grams; cyclohexane ACS (Caledon), 50 grams, were ball milled overnight. TDI-80, 9 grams, and Desmodur RF, 5 grams, in dichloromethane, 20 milliliters, were added to the pigment mixture, 67 grams, after ball milling. This mixture was homogenized with a Brinkmann homogenizer PT 10-35 set at speed 9 for 90 seconds (generator PT-20). The mixture was then dispersed in a 1 percent poly(vinyl alcohol) solution, 1,000 milliliters, and 2-decanol, 0.5 milliliter, with a Brinkmann homogenizer PT 10-35 set at speed 6 for 10 seconds (generator PT 35/4). The mixture was transferred to a 2 liter beaker equipped with a mechanical stirrer, and an oil bath under the beaker. After 10 minutes of stirring, diethylenetriamine, 5 milliliters, in water, 22 milliliters, was added to it over a period of 2 minutes using a dropping funnel. The mixture was stirred at room temperature for 3 hours. The volume was then broughtto 2 liters, and the solution heated overnight at 70° C. to let the reaction go to completion and to remove the volatiles. The reaction mixture was allowed to stabilize at room temperature. The toner was filtered through a 212 mesh filter, washed and centrifuged at 12,000 rpm, 10 minutes, 3 times with water. It was dried using a Buchi 190 mini spray dryer at an inlet temperature of 128° C. and an outlettemperature of 84° C. A blue toner was obtained containing as core polymer polyisobutylene, about 45 percent by weight, the blue pigment, about 19 percent by weight; and a polyurea shell, about 36 percent by weight.

EXAMPLE V

A colored cold pressure encapsulated toner was prepared as follows: Oil Red 2144 (Passaic Color and Chemical Co.), 10 grams; Vistanex LMMH, 16 grams; Kraton DX-1 115, 8 grams; 1,1,1 trichloroethane, 100 grams, were ball milled for 16 hours. TDI-80, 9 grams, and Desmodur RF, 5 grams, in dichloromethane, 20 milliliters, were added to the pigment mixture, 67 grams, after ball milling. This mixture was homogenized with a Brinkmann homogenizer PT 10-35 set at speed 9 for 90 seconds (generator PT-20). The mixture was then dispersed in a 1 percent poly(vinyl alcohol) solution, 1,000 milliliters, and 2-decanol, 0.5 milliliter, with a Brinkmann homogenizer PT 10-35 set at speed 6 for 10 seconds. Thereafter, the mixture was transferred to a 2 liter beaker equipped with a mechanical stirrer, and an oil bath under the beaker. After 10 minutes of stirring, diethylenetriamine, 5 milliliters, in water, 22 milliliters, was added over a period of 2 minutes using a dropping funnel. The mixture was stirred at room temperature for 3 hours. During this period an interfacial polymerization reaction ensued enabling the polyurea polymer shell to formulate. The volume of solution was then brought to 2 liters, and the solution heated overnight at 70° C. to permit completion of the condensation reaction between the amine and isocyanate, and to remove some of the trichloroethane, and dichloromethane volatiles. The reaction mixture was then allowed to stabilize at room temperature. Subsequently, the toner composition resulting was filtered through a 212 μm mesh filter to remove larger aggregates, washed and centrifuged at 12,000 rpm for 10 minutes, three times with water. The toner product was then dried using a Buchi 90 mini spray dryer at an inlet temperature of 135° C. and an outlet temperature of 93° C. to yield free flowing particles of a toner size about 12 microns average diameter. A red toner with a core containing polyisobutylene, 25 percent by weight; a styrene butadiene block copolymer, 12 percent by weight; a red pigment, 16 percent by weight; and a polyurea shell, 47 percent by weight, was obtained.

EXAMPLE VI

A colored cold pressure encapsulated toner was prepared by repeating the process of Example V, with the exceptions that Pylam Oil Yellow (Pylam Company), 2.5 grams; Vistanex LMMH, 8 grams; Kraton DX 1115 (Shell), 4 grams; 1,1,1 trichloroethane, 85 grams; were ball milled overnight. Thereafter, TDI-80, 9 grams, and Desmodur RF, 5 grams, in dichloromethane, 20 milliliters, were added to the pigment mixture after ball milling. This mixture was homogenized with a Brinkmann homogenizer PT 10-35 set at speed 9 for 90 seconds (generator PT-20). The mixture was then dispersed in a 1 percent poly(vinyl alcohol) solution, 1,000 milliliters and 2-decanol, 0.5 milliliter, with a Brinkmann homogenizer PT 10-35 set speed 7 for 25 seconds (generator PT 35/4). The toner particles obtained were permitted to settle overnight, and no centrifugation was used. The yellow toner resulting spray dried very well under conditions similar to those selected for Example V, and there was no clogging of the spray dryer nozzle, and the particles obtained did not fuse together during the drying process. A yellow toner with a core containing polyisobutylene, about 28 percent by weight; a styrene butadiene copolymer, about 13 percent by weight; a yellow pigment, about 9 percent by weight; and a polyurea shell, about 50 percent by weight, was obtained.

EXAMPLE VII

A colored cold pressure encapsulated toner was prepared as follows: Sudan blue, 5.68 grams; Kraton (Shell) DX-1 1 15, 2.2 grams; Vistanex LMMH (a polyisobutylene from EXXON Corp.), 19.8 grams; and cyclohexane ACS (Caledon), 1 14.3 grams, were mixed and dissolved overnight on a wrist shaker at room temperature. The mixture was homogenized using a Brinkmann PT 45/80 homogenizer with a PT-20 generator for a period of 2 minutes at 9,000 rpm. The mixture was cooled in a water bath while being homogenized. Furthermore, the homogenizing time was not continuous, the homogenizer was run in periods of 1 minute with 1 minute of resting time. Thereafter, TDI-80, 10 grams; Desmodur RF, 25 milliliters, of a 20 percent solution in dichloromethane; and dichloromethane, 20 milliliters, (ACS, Caledon) were added to the previous mixture and homogenized with a PT 45/80 homogenizer and a PT-20 generator for 1 minute at 9,000 rpm (cooled). The mixture was added to a 0.75 percent poly(vinyl alcohol), 500 milliliters, and 2-decanol, 0.5 milliliter, and dispersed for 20 seconds at 6,500 rpm using a PT45/80 homogenizer and a PT 35/4 probe generator. The reaction mixture was transferred to a 2 liter beaker equipped with a mechanical stirrer and an oil bath was placed thereunder. The mixture was stirred and heated at 43° C. for two hours, and during this time an interfacial polymerization took place to form a polyurea shell. The mixture was allowed to stir at 65° C. overnight. This removed some of the cyclohexane from the mixture and allowed further interfacial polymerization. The toner resulting was then washed three times with water, each time being settled using an IEC-B20A centrifuge at 8,000 rpm for a period of 12 minutes. A 212 μm screen filter was used to remove any aggregates. The toner was then spray dried with an inlet temperature of 120° C. and outlet temperature of 95° C. The average particle size of the toner was 13.8 microns, and its geometric standard derivation (GSD) was 1.43. A blue toner with a core containing polyisobutylene, about 47 percent by weight; a styrene butadiene block copolymer, about 5 percent by weight; a blue pigment, about 13 percent by weight; and a polyurea shell, about 35 percent by weight, was obtained. For this toner, the fix level was evaluated by a Taber abrasion test yielding a ratio of optical density before, and after the test of 0.30, based on a standard optical density of 1.0.

EXAMPLE VIII

A colored cold pressure encapsulated toner was prepared as follows: Sudan Blue, 5.68 grams; Kraton (Shell) DX-1115, 4.4 grams; Vistanex LMMH (a polyisobutylene from EXXON Corp.), 17.6 grams; and cyclohexane ACS (Caledon), 114.3 grams were mixed and dissolved overnight in a wrist shaker at room temperature. The mixture was homogenized using a Brinkmann PT 45/80 homogenizer with a PT-20 generator for a period of 60 seconds at speed 6. The mixture was cooled in a water bath while being homogenized. Thereafter, TDI-80, 10 grams, Desmodur RF, 25 milliliters, of a 20 percent solution in dichloromethane; and dichloromethane, ACS Caledon, 20 milliliters, were added and homogenized with a PT 45/80 homogenizer and a PT-20 generator for 45 seconds at speed 6 (cooled). The mixture was added to a 0.75 percent poly(vinyl alcohol) solution, 500 milliliters, and 2-decanol, 0.5 milliliter, and dispersed for 20 seconds at speed setting 5 using a PT 45/80 homogenizer and a PT 35/4 probe generator. The reaction mixture was then transferred to a 2 liter beaker equipped with a mechanical stirrer and an oil bath was placed thereunder. Subsequently, the mixture was stirred and heated at 41° C. for two hours, and during this time an interfacial polymerization reaction took place enabling the formulation of a polyurea shell. The mixture was allowed to stir at 62° C. overnight. This removed some of the volatiles from the mixture and allowed further interfacial polymerization. The toner was then washed three times with water, each time being settled using an IEC-B20A centrifuge at 8,000 rpm for a period of 12 minutes. A 212 μm screen filter was used to remove any aggregates. The toner was spray dried with an inlet temperature of 124° C. and outlet temperature of 94° C. The average particle size of the toner was 20.0 microns, and its GSD was 1.37. A blue toner with a core containing polyisobutylene, about 42 percent by weight; a styrene butadiene block copolymer, about 10 percent by weight; a blue pigment, about 13 percent by weight; and a polyurea shell, about 35 percent by weight, was obtained. This blue toner was cold pressure fixed to plain paper with a Hitachi three roll pressure fuser at greater than 2,000 psi pressures. The higher concentration of Kraton, 10 percent, in this toner resulted in the toner having rubbery characteristics, in that the rheological characteristics of thistoner were such that if the toner is rubbed with a finger, it results in the toner lifting off the paper forming small rubber like ball residues.

EXAMPLE IX

A colored cold pressure encapsulated toner was prepared as follows: Sudan Blue, 8.71 grams; Kraton (Shell) DX-1115, 2.2 grams; Vistanex LMMH (a polyisobutylene from EXXON Corp.), 19.8 grams;and cyclohexane ACS (Caledon), 114.3 grams, were mixed and dissolved overnight in a wrist shaker at room temperature. The mixture was homogenized using a Brinkmann PT 45/80 homogenizer with a PT-20 generator for a period of 120 seconds at 9,000 rpm. The mixture was cooled in a water bath while being homogenized. TDI-80, 10 grams; Desmodur RF, 25 milliliters of a 20 percent solution in dichloromethane; and dichloromethane, ACS (Caledon), 20 milliliters, were added to the previous mixture and homogenized with a PT45/80 homogenizer and a PT-20 generator for 60 seconds at 9,000 rpm (cooled). The mixture was added to 0.75 percent poly(vinyl alcohol), 500 milliliters, and 2-decanol, 0.5 milliliter, and dispersed for 20 seconds at 6,500 rpm using a PT 45/80 homogenizer and a PT 35/4 probe generator. The reaction mixture was transferred to a 2 liter beaker equipped with a mechanical stirrer and an oil bath was placed under it. The mixture was stirred and heated at 44° C. for two hours, and during this time an interfacial polymerization took place to form a polyurea shell. The mixture continued to stir at 66° C. overnight. This removed some of the volatiles from the mixture and allowed further interfacial polymerization. The toner was washed three times with water, each time being settled using an IEC-B20A centrifuge at 8,000 rpm for a period of 12 minutes. A 212 μm screen filter was used to remove any aggregates. The toner was spray dried with an inlet temperature of 126° C. and outlettemperature of 98° C. The average particle size of the toner was 14.8 microns and its GSD was 1.33. A blue toner with a core containing polyisobutylene, about 43 percent by weight; a styrene butadiene block copolymer, about 5 percent by weight; a blue pigment, about 19 percent by weight; and a polyurea shell, about 35 percent by weight, was obtained. The resulting blue toner was pressure fixable to plain paper with a Hitachi three roll pressure fuser at greaterthan 2,000 psi pressures.

EXAMPLE X

A colored cold pressure encapsulated toner was prepared as follows: Sudan Blue, 5.68 grams; Kraton (Shell) DX-1115, 3.3 grams; Vistanex LMMH (a polyisobutylene from EXXON Corp.), 18.7 grams; and cyclohexane ACS (Caledon), 114.3 grams, were mixed and dissolved overnight in a wrist shaker at room temperature. The mixture was homogenized using a Brinkmann PT 45/80 homogenizer with a PT-20 generator for a period of 120 seconds at 9,000 rpm. The mixture was cooled in a water bath while being homogenized. TDI-80, 10 grams; Desmodur RF, 25 milliliters, of a 20 percent solution in dichloromethane; and dichloromethane, ACS (Caledon), 25 milliliters, were added to the previous mixture and homogenized with a PT45/80 homogenizer and a PT20 generator for 60 seconds at 9,000 rpm (cooled). The mixture was added to 0.75 percent poly(vinyl alcohol), 500 milliliters, and 2-decanol, 0.5 milliliter, and dispersed for 20 seconds at 6,500 rpm using a PT 45/80 homogenizer and a PT-20 probe generator. The reaction mixture was transferred to a 2 liter beaker equipped with a mechanical stirrer and an oil bath was placed under it. The mixture was stirred and heated at 40° C. for two hours, and during this time an interfacial polymerization took place to form a polyurea shell. The mixture continued to stir at 63° C. overnight. This removed some of the volatiles from the mixture and allowed further interfacial polymerization. The toner was washed three times with water, each time being settled using an IEC-B20A centrifuge at 8,000 rpm for a period of 12 minutes. A 212 μm screen filter was used to remove any aggregates. The toner was spray dried with an inlet temperature of 119° C. and outlettemperature of 92° C. The average particle size of the toner was 13.5 microns and its GSD was 1.43. A blue toner with a core containing polyisobutylene, about 44 percent by weight; a styrene butadiene block copolymer, about 8 percent by weight; a blue pigment, about 13 percent by weight; and a polyurea shell, about 35 percent by weight, was obtained. This blue toner was cold pressure fixed with a Hitachi three roll pressure fuser at greater than 2,000 psi pressures. After addition of about 0.4 percent by weight of Aerosil R972, Degussa Canada Ltd., this toner was selected to develop images in a xerographic test fixture using an Ektaprint L organic photoreceptor belt (green). The images exhibit strong smear resistance as heavy rubbing with fingers indicated that no toner was coming off the paper underthose conditions.

EXAMPLE XI

A colored cold pressure encapsulated toner was prepared as follows: Sudan Blue, 2.65 grams; Vistanex LMMH (a polyisobutylene from EXXON Corp.), 22.0 grams; and cyclohexane ACS (Caledon), 120.0 grams, were mixed and dissolved overnight in a wrist shaker at room temperature. The mixture was homogenized using a Brinkmann PT 45/80 homogenizer with a PT-20 generator for a period of 120 seconds at 9,000 rpm. The mixture was cooled in a water bath while being homogenized. TDI-80, 13.0 grams; Desmodur RF, 25 milliliters, of a 20 percent solution in dichloromethane; and dichloromethane, ACS (Caledon), 20 milliliters, were added to the previous mixture and homogenized with a PT 45/80 homogenizer and a PT-20 generator for 60 seconds at 9,000 rpm (cooled). The mixture was added to 0.75 percent poly(vinyl alcohol), 500 milliliters, and 2-decanol, 0.5 milliliter, and dispersed for 20 seconds at 6,500 rpm using a PT 45/80 homogenizer and a PT-20 probe generator. The reaction mixture was transferred to a 2 liter beaker equipped with a mechanical stirrer and an oil bath was placed under it. The mixture was stirred and heated at 42° C. for two hours, and during this time an interfacial polymerization took place to form a polyurea shell. The mixture continued to stir at 64° C. overnight. This removed some of the volatiles from the mixture and allowed further interfacial polymerization. The toner was washed three times with water, each time being settled using an IEC-B20A centrifuge at 8,000 rpm for a period of 12 minutes. A 212 μm screen filter was used to remove any aggregates. The toner was spray dried with an inlet temperature of 120° C. and outlet temperature of 98° C. The average particle size of the toner was 13.1 microns and its GSD was 1.37. A blue toner with a core containing polyisobutylene, about 52 percent by weight; a blue pigment, about 6 percent by weight; and a polyurea shell, about 42 percent by weight, was obtained. This blue toner is pressure fixable with a Hitachi three roll pressure fuser at greater than 2,000 psi pressures.

EXAMPLE XII

A colored cold pressure encapsulated toner was prepared as follows: Sudan Blue, 2.65 grams;Vistanex LMMH (a polyisobutylene from EXXON Corp.), 22.0 grams; and cyclohexane ACS (Caledon), 120.0 grams, were mixed and dissolved overnight in a wrist shaker at room temperature. The mixture was homogenized using a Brinkmann PT 45/80 homogenizer with a PT-20 generator for a period of 90 seconds at speed 7. The mixture was cooled in a water bath while being homogenized. TDI-80, 13:0 grams; Desmodur RF, 25 milliliters, of a 20 percent solution in dichloromethane; and dichloromethane, ACS (Caledon), 20 milliliters, were added to the previous mixture and homogenized with a PT45/80 homogenizer and a PT-20 generator for 60 seconds at speed 7 (cooled). The mixture was added to 0.75 percent poly(vinyl alcohol), 500 milliliters, and 2-decanol, 0.5 milliliter, and dispersed for 20 seconds at speed setting 5⅓ using a PT 45/80 homogenizer and a PT 35/4 probe generator. The reaction mixture was transferred to a 2 liter beaker equipped with a mechanical stirrer and an oil bath was placed under it. The mixture was stirred and heated at 39° C. for two hours, and during this time an interfacial polymerization took place to form a polyurea shell. The mixture continued to stir at 69° C. overnight. This removed some of the volatiles from the mixture and allowed further interfacial polymerization. The toner was washed three times with water, each time being settled using an IEC-B20A centrifuge at 8,000 rpm for a period of 12 minutes. A 212 μm screen filter was used to remove any aggregates. The toner was spray dried with an inlettemperature of 120° C. and outlet temperature of 92° C. The average particle size of the toner was 12.4 microns and its GSD was 1.37. A blue toner with a core containing polyisobutylene, about 52 percent by weight; a blue pigment, about 6 percent by weight; and a polyurea shell, about 42 percent by weight, was obtained. This blue toner is pressure fixable with a Hitachi three roll pressure fuser at greater than 2,000 psi pressure.

EXAMPLE XIII

A colored cold pressure fixable encapsulated toner was prepared as follows: printing ink (CFC 556-5026, Canadian Fine Color Corp.), 20 grams; and Vistanex LMMH, 12 grams, were dissolved in dichloromethane, 20 milliliters, in the presence of TDI-80, a mixture of 2,4 and 2,6 toluene diisocyanate, 10 grams; and Desmodur RF (tris(p-isocyanato-phenyl)thiophosphate), 5 grams, in dichloromethane, 20 milliliters. The mixture was then dispersed in a 0.75 percent poly(vinylalcohol)solution, 88 percent hyydroxylated, molecular weight 96,000 g/mole, 500 milliliters; and 2-decanol, 0.5 milliliter, with a Brinkmann homogenizer PT 10-35 set at speed 6 for 10 seconds (generator PT 35/4). This mixture was transferred to a 2 liter beaker equipped with a mechanical stirrer, and an oil bath underthe beaker. The temperature was raised to 55° C. for 3 hours and further raised to 70° C. During this hydrolysis, an interfacial polymerization resulted, and a polyurea shell was formed. Heating was then continued overnight. The next day the temperature was lowered to room temperature and the toner was isolated by centrifugation, washed repeatedly with distilled water and spray dried with a Buchi 190 spray dryer. There was then added to the resulting toner 0.5 percent zinc stearate and 0.5 percent aluminum oxide C.

Other modifications of the present invention may occur to those skilled in the art based upon a reading of the present disclosure, and these modifications are intended to be included within the scope of the present invention.

What is claimed is:

1. A composition suitable for use as an electrophotographic developer, said composition comprising a cold pressure fixable colored toner composition comprised of a core containing a polymer selected from the Group consisting of polyolefins, polyostrene-butadiene copolymers, polybutadienes, polybutenes, polyisoprenes and polysiloxane. in which is dipersed pigment particles selected from the group consisting of cyan, magenta, red, yellow pigments, and mixtures thereof, other than carbon blacks and magnetites; and encapsulated within a polymericshell formulated by an interfacial polymerization.

2. A toner composition in accordance with claim 1 wherein the polymer is polyisobutylene.

3. A toner composition in accordance with claim 1 wherein the cyan pigmentis Sudan Blue.

4. A toner composition in accordance with claim 1 wherein the magenta pigment is Hostaperm Pink E.

5. A toner composition in accordance with claim 1 wherein the yellow pigment is Novaperm Yellow FGL.

6. A toner composition in accordance with claim 1 wherein the shell is a polyurea.

7. A toner composition in accordance with claim 1 wherein the polymer is present in an amount of from about 20 to about 80 percent by weight, the pigment component is present in an amount of from about 5 to 25 percent by weight, and the shell is present in an amount of from about 15 to about 25 percent by weight.

8. A composition suitable for use as an electrophotographic said composition comprising a cold pressure fixable colored toner composition comprised of a core containing a polymer selected from the Group consisting of polyolefins, polystyrene-butadiene copolymers, polybutadienes, polybutenes, polyisoprenes and polysiloxane. in which is dispersed a newsprint ink compried os a polymer with a pigment therein, other than carbon blacks and magnetites; and encapsulated within a polymeric shell formulated by an interfacial polymerization.

9. A toner composition in accordance with claim 8 wherein the polymer is polyisobutylene.

10. A toner composition in accordance with claim 8 wherein the shell is a polyurea.

11. A toner composition in accordance with claim 1 further including therein additive particles selected from the group consisting of colloidal silicas, metal salts, and metal salts of fatty acids.

12. A toner composition in accordance with claim 8 further including therein additive particles selected from the group consisting of colloidal silicas, metal salts, and metal salts of fatty acids.

13. A toner composition in accordance with claim 11 wherein the additive is zinc stearate.

14. A toner composition in accordance with claim 12 wherein the additive is zinc stearate.

15. A composition suitable for use as an electrophotographic developer, said composition comprising a cold pressure fixable colored toner composition comprised of a core containing a polyolefin polymer with a weight average molecular weight of from about 50,000 to about 100,000 in which is dispersed pigment particles selected from the group consisting of cyan, magenta, red, yellow pigments and mixtures thereof, other than carbon blacks and magnetites; and encapsulated with a polymeric shell formulated by an interfacial polymerization.

16. A toner composition in accordance with claim 15 wherein the polyolefin is a polyisobutylene.

17. A toner composition in accordance with claim 15 wherein the polyolefin is selected from the group consisting of polystyrene butadiene copolymers, and polybutadienes.

18. A toner composition in accordance with claim 1 wherein the polymer is selected from the group consisting of polybutenes, polyisoprenes, and polysiloxane copolymers.

* * * * *